United States Patent [19]

Hinchman

[11] 3,976,298

[45] Aug. 24, 1976

[54] DART

[76] Inventor: LeRay V. Hinchman, 2622 Carnegie Lane, Redondo Beach, Calif. 90278

[22] Filed: June 16, 1975

[21] Appl. No.: 587,326

[52] U.S. Cl. ..... 273/106.5 R; 273/106.5 B; 273/106.5 C

[51] Int. Cl.[2] ..... A63B 65/02

[58] Field of Search ..... 273/106.5, 106

[56] References Cited

UNITED STATES PATENTS

| | | | |
|---|---|---|---|
| 735,415 | 8/1903 | Schrodel | 273/106.5 A |
| 2,796,691 | 6/1957 | Norris | 273/106.5 B UX |
| 3,829,094 | 8/1974 | Goldfarb et al. | 273/106.5 A X |

FOREIGN PATENTS OR APPLICATIONS

| | | | |
|---|---|---|---|
| 82,073 | 8/1919 | Switzerland | 273/106.5 B |
| 516,848 | 1/1940 | United Kingdom | 273/106.5 R |

*Primary Examiner*—Paul E. Shapiro
*Attorney, Agent, or Firm*—Robert J. Schaap

[57] ABSTRACT

A manually propellable dart for propelling toward a target or like member, and which dart comprises a pin section having an elongate shaft with one pointed end for impact into a target or like member. The dart includes an elongate main body with a fore body section and an aft body section. The shaft of the pin section has a hub mounted thereon and the shaft has an enlarged end opposite the pointed end which is removably retained in a recess formed within the aft body section. The main body is designed so that it is capable of being engaged by a user for projection toward the target or like member. A tail fin member is secured to the end of the elongate body opposite the pointed end. A forward end of the fore body section is provided with a sleeve portion which extends over the hub and has a rear abutment surface which engages a forward abutment surface on the aft body section. Moreover, a reduced boss on the rearward end of the fore body section removably engages the side wall of the recess in the aft end. Thus, when the pointed end of the pin section engages a target or like member, the enlarged head will engage the rear wall of the recess to cause an initial separation between the elongate fore section and the aft body section. In this way, the forward movement of the dart will cause a forward inertial movement of the fore body section causing removal of the boss from the recess, and thereby permitting complete separation between the fore section and the aft body section.

16 Claims, 5 Drawing Figures

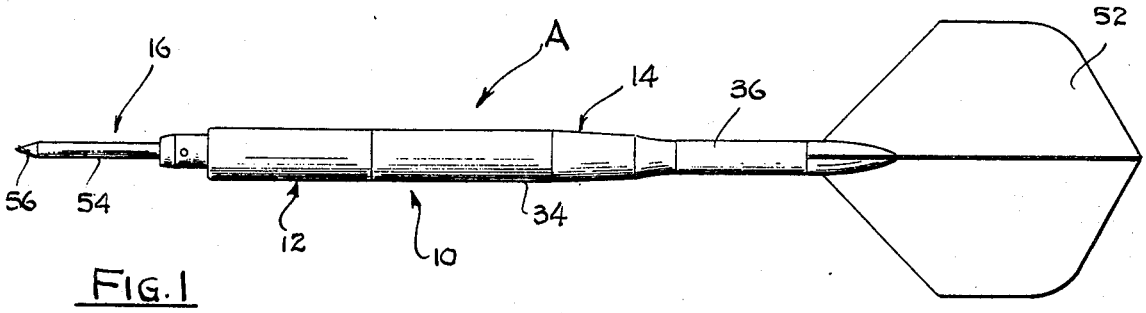
FIG. 1
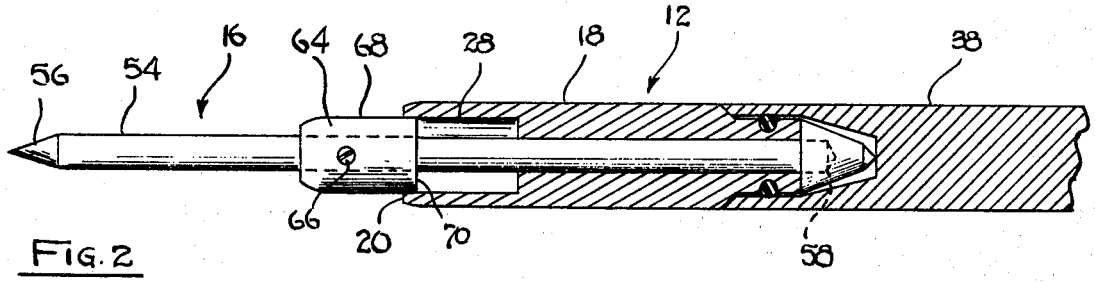
FIG. 2
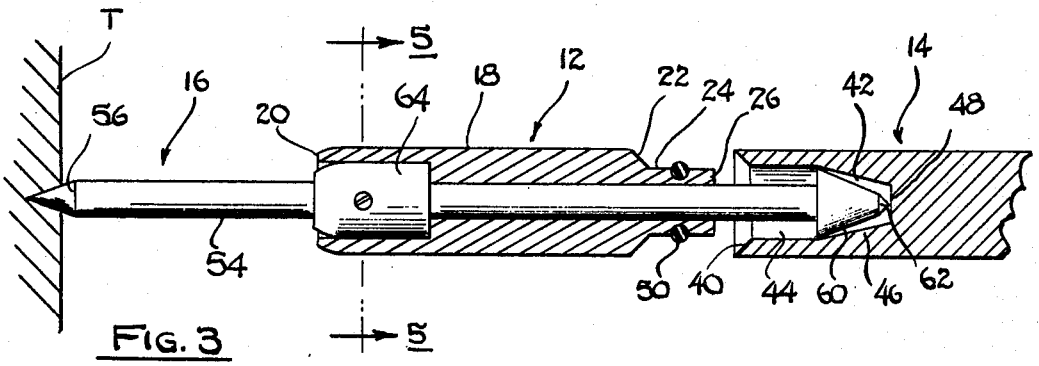
FIG. 3
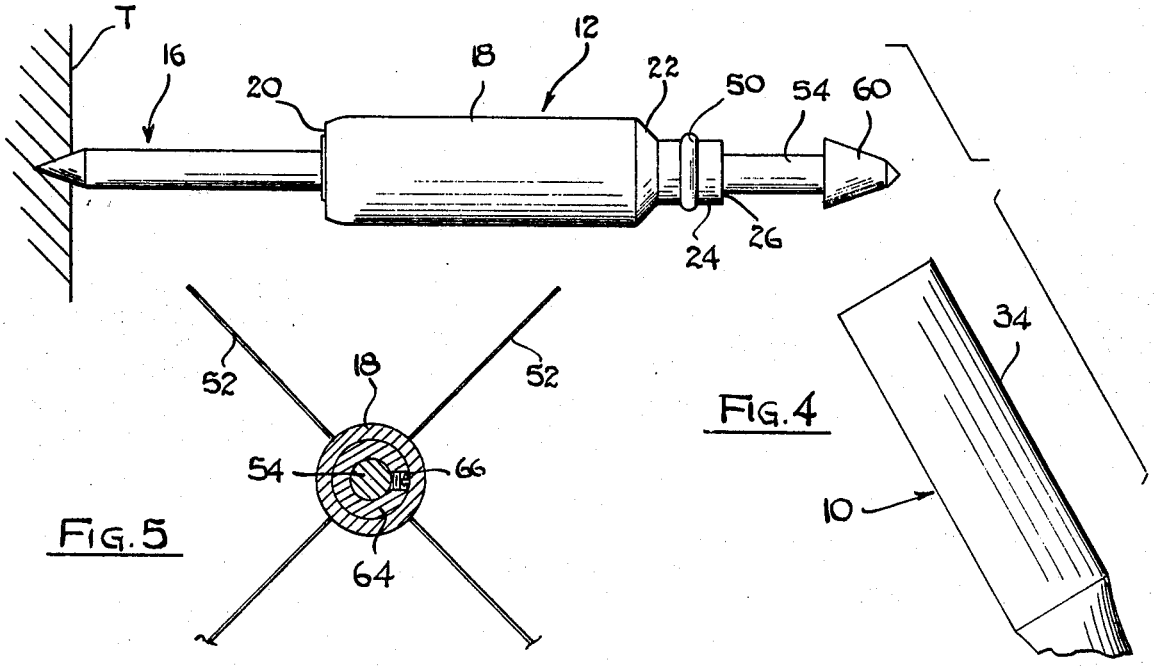
FIG. 4
FIG. 5

DART

BACKGROUND OF THE INVENTION

This invention relates in general to certain new and useful improvements in darts, and, more particularly, in darts which are formed in separable segmented portions.

For many years, the throwing of darts toward a target or like member has been a well accepted sport and recreational activity. Typically, these darts include an elongate body section with a pointed pin-like member on one end thereof and tail fins on the opposite end thereof, the latter of which are designed to provide aerodynamic stability. Darts of this type have become popular in various dart games which are typically used by amateurs and similar users engaged in sport activities and like recreational activities.

However, the manual propelling of a dart toward a target has adopted a more serious sports activity in which dart throwers are quite concerned about and will predicate purchase on the construction and aerodynamic stability of the darts which they intend to use. In this respect, the professional dart thrower has generated a demand for a dart of high quality construction and with improved aerodynamic qualities. Typically, these darts are constructed of alloy metals and various uniquely designed tail fins and body sections which enable improved throwing accuracy of the dart toward a target.

As indicated above, essentially all darts which are used by amateurs and professionals alike normally include three main components, namely, an elongate body section with a pointed end or pin-like end at one end of the body section and tail fins at the opposite end of the body section. In this respect, the pin section is diametrically reduced with respect to the body section and the tail fins are diametrally increased in size, quite substantially, with respect to the body section. With respect to the amateur dart thrower, this construction is quite effective. In addition, and with respect to the professional dart thrower, this construction is effective from the standpoint of the aerodynamic qualities, although the professional dart thrower is capable of propelling the dart into the bull's-eye or other desired area of the target much more frequently than the amateur.

Oftentimes, the professional dart thrower will propel several darts into the most desirable areas of the target, such as th so-called "triple" areas, e.g. the triple twenty area, and in some cases the bull's-eye area, and these darts which remain in these desired areas thereby impair, if not hinder, further propelling of additional darts into that area. One of the primary problems revolves around the fact that tail fins on the dart are substantially increased in size with respect to the overall size of the projectile end, that is the end carrying the pin-like member. Consequently, when subsequent darts are thrown, they may engage the tail sections of these previously thrown darts and thereby prevent additional darts from entering into the desired areas.

In accordance with the above, it can be observed that one of the primary problems in professional dart throwing is that the tail fins and the elongate body section interfere with the throwing of additional darts which thereby impairs the possible score achieving ability of the thrower. The present invention overcomes this problem in the provision of a segmented dart in which the body section, including the tail section, separates from the projectile section upon impact.

OBJECTS OF THE INVENTION

It is therefore the primary object of the present invention to provide a manually propellable dart which comprises an elongate body section and a projectile section and in which the body section is separable from the projectile section.

It is another object of the present invention to provide a dart of the type stated which may be constructed of a number of highly desirable materials and with the desired aerodynamic configuration to render a dart which is effectively usable by a professional dart thrower.

It is a further object of the present invention to provide a dart of the type stated which is highly reliable in its operation and which is durable in its construction.

It is an additional object of the present invention to provide a dart of the type stated which can be constructed in segmented parts so that various components thereof can be interchanged upon damage to any one component thereof.

It is another salient object of the present invention to provide a method of throwing a segmented dart in which the projectile end thereof may be projected into a target or like member and in which the body section thereof is separable therefrom upon impact.

With the above and other objects in view, my invention resides in the novel features of form, construction, arrangement and combination of parts presently described and pointed out in the claims.

GENERAL DESCRIPTION

The present invention relates to a dart which is constructed in segmented portions including a pin section, a main body section segmented into a forward body section, or so-called "fore" body section, and an after body section, or so-called "aft" body section, and a tail fin section on said aft body section. The pin section has a pointed end which is capable of being propelled into a target or like member.

In the broad aspect of the present invention, the pin section comprises an enlarged end which is capable of extending into a recess on the forward end of the aft body section. The fore body section is provided with an extension on the rearward end thereof which also extends into said recess for retentively, but nevertheless removably, holding the pin section and the fore body section to the aft body section. Furthermore, an automatic disconnect means is provided to disconnect the aft body section from the fore body section when the pin section impacts on the target or like member.

In more detail, the pin section comprises an elongate shaft having a pointed first end which extends into the target or like member, and the opposite or second end thereof is provided with an enlarged head which extends into the recess of the elongate aft body section. Moreover, an enlarged hub is formed on the shaft. The fore body section extends over the shaft and is located in slidable contact with the hub and, in this case, the fore body section is provided with an abutment shoulder or abutment end and the aft body section is provided with a mating abutment end.

In accordance with a preferred aspect of the present invention, the recess in the aft body section is provided with a greater depth than the head which is removably located therein. When the pointed end of the pin section impacts upon a target or like member, the initial movement of the entire dart causes the head on the pin section to engage the recess and cause an initial separation between the fore and aft body sections. Moreover, inertial force of the fore body section will cause the fore body section to move forwardly, effectively, with respect to the pin section, and away from the aft body section. In this way, separation is initially created upon impact between the head on the pin section and the recess in the aft body section. Further, the forward momentum of the dart toward the target causes the fore body section to further create separation between the fore body section and the aft body section.

BRIEF DESCRIPTION OF THE DRAWINGS

Having thus described the invention in general terms, reference will now be made to the accompanying drawings in which:

FIG. 1 is a side elevational view of a dart constructed in accordance with and embodying the present invention;

FIG. 2 is a fragmentary vertical sectional view of the dart of FIG. 1, showing a portion thereof in section and a portion in side elevation;

FIG. 3 is a fragmentary partial vertical sectional view, similar to FIG. 2, and showing the components of the dart after an initial impact on a target or like member;

FIG. 4 is a side elevational view of the dart showing complete separation of the components in FIG. 3; and FIG. 5 is a vertical sectional view taken along line 5—5 of FIG. 4.

DETAILED DESCRIPTION

Referring now in more detail and by reference characters to the drawings which illustrates a preferred embodiment of the present invention, A designates a dart of the type which is manually operable for propelling toward a target or like member designated as T in the drawings. In this case, the dart A is designed so that it can be engaged by an individual and propelled toward a target area. Nevertheless, it may be observed that the present invention is applicable to other forms of projectiles such as arrows and the like. The target area may adopt any form of receiving area such as a conventional target having a series of score rings with a so-called "bull's-eye" ring (not shown), or any other form of receiving member.

The dart A of the present invention comprises a main body 10, often referred to in the art as a "barrel", and which is divided into a forward body section 12, or so-called "fore body section", and a rear body section 14, often referred to as an after body section or so-called "aft body section". The dart A of the present invention also includes a pin section 16, often referred to in the art as a "point", and each of these sections will be described in more detail hereinafter.

The fore body section 12 includes a cylindrical side wall 18 having a forward transverse end face 20. In addition, the fore body section 12 includes an inwardly tapered abutment wall 22 at its rearward end and which merges into a cylindrically shaped, diametrically-reduced boss, or extension, 24, the latter having a flat rearward end wall 26.

The fore body section 12 is also provided with a diametrally enlarged guide recess 28 which opens at the front transverse end wall 20. In addition, the fore body section 12 is provided with an axially extending central bore opening into the recess 28 and at the flat end wall 26, for reasons which will presently more fully appear.

The aft body section 14 is comprised of an elongate, cylindrically shaped forward portion 32, essentially formed of a metal material, and a rearward portion 36, essentially formed of a plastic material. The rearward portion 36 is also cylindrical in shape but is somewhat diametrally reduced with respect to the forward portion 34. In this respect, it can be observed that the aft body section 14 is substantially longer than the fore body section 12. Moreover, the rearward portion 36 of the aft body section 14 is formed of a plastic material in order to reduce the weight thereof. The length of the entire aft body section is important in order to provide the increased aerodynamic stability. Nevertheless, it is desirable to reduce the weight at the rearward end thereof, and, hence, the plastic material forming the rearward portion 36 has been found to be highly effective.

The forward portion 34 of the aft body section 14 is also provided with a cylindrical outer surface 38 and with a forward inwardly tapered end wall 40 serving as an abutment wall. Moreover, the inwardly tapered end wall 40 leads into a recess 42 and which, in this case, is formed by a cylindrical side wall 44 and an inwardly tapering side wall 46, the latter of which merges into a rearwardly presented end wall 48, in the manner as more fully illustrated in FIG. 3 of the drawings.

By reference to FIGS. 2 and 3 of the drawings, it can be observed that the tapered abutment wall 40 on the aft body section 14 is capable of engaging the rearward tapered abutment wall 22 on the fore body section 12 when the two body sections are coupled together, in the manner as illustrated in FIG. 2. Moreover, it can be observed that the diametrally reduced boss 24 extends within the recess 42. In a preferred aspect of the present invention, the boss 24 may be provided with an annular sealing ring 50 which is designed to engage the cylindrical wall 44 forming part of the recess 42. This sealing ring 50 may be formed of neoprene rubber or other like material. In addition, the sealing ring 50 could be formed of a suitable metal clamp-type ring or the like. Thus, in this way, the boss 24 is retentively, but nevertheless removably, held within the recess 42.

The rearward body portion 36 of the aft body section 14 is provided with a pair of perpendicularly disposed slots (not shown) in order to accommodate stabilizing fins or so-called "tail fins" 52. The tail fins 52 are preferably formed of a plastic material in order to provide a light weight at the rearward end of the dart A, and these tail fins 52 are essentially conventional in their construction. These tail fins 52 are durable in their construction and provide the proper aerodynamic characteristics for the dart A. Nevertheless, it can be observed that the tail fins 52 are removably, but nevertheless retentively, held on the rearward end of the main body 10 due to the fact that they fit within the perpendicularly disposed slots.

The pin section 16 generally includes a cylindrically shaped main shaft 54 and which is provided with a pointed forward end 56 for piercing the target T or like member. By further reference to FIGS. 2 and 3 of the drawings, it can be observed that the main shaft 54 extends axially through the central bore of the fore body section 12 and beyond the rear face 26 thereof. Moreover, the main shaft 54 is provided with an enlarged head 58 at its rearward end and the enlarged head 58 is provided with a tapered side wall 60 and a pointed end wall 62. In this case, it can be observed that the forward margin of the tapered side wall 60 is located at the area where the cylindrical side wall 44 merges into the tapered side wall 46 forming the recess 42.

The pin section 16 is also provided with a guide collar 64 which is cylindrically disposed over a portion of the shaft 54 and is press-fitted thereon, although it is possible to retain the collar 64 on the shaft 54 by means of a set screw 66. In this case, it can be observed that the collar 64 is provided with a cylindrically shaped side wall 68 and a rearwardly presented end wall 70 which engages the end wall of the recess 28 in the manner as illustrated in FIG. 3 of the drawings.

As an alternate form of construction, it should be realized that the rear portion of the shaft 54, that is the portion of the shaft beyond the sleeve 64, could be threaded into the sleeve 64. In this case, the sleeve 64 would then be press-fitted on, or otherwise secured to or integrally formed with the main shaft 54. This form of construction may be preferred in some embodiments, due to the fact that the shaft 54 and the pointed end 56 are preferably formed of a relatively expensive carbontype steel alloy material.

As indicated above, the pin section 16, as well as the fore body section 12 and the forward portion 34 of the aft body section 14, is formed of a metal material. In this case, it is preferable to manufacture the pin section 16 from those materials normally used in projectiles of this type, such as a carbon-type steel. Nevertheless, the other metal components of the dart could be formed of other metals. Thus, the forward portion of the aft body section 14 and the fore body section 12 could be formed of other structural materials including the heavyweight metals, such as steel or brass or copper tungsten, although some light-weight metals such as aluminum may be used in some cases. The rear portion 36 of the aft body section 14 could be formed of a number of well-known lightweight plastic materials, including polyethylene, polystyrene, polybutadiene and the like. The plastic materials may be formed in any of a number of known plastic molding operations, such as thermo-forming, blow-molding, injection molding and the like. Notwithstanding, it can be observed that in some uses the dart A could all be formed of plastic materials, or, for that matter, could all be formed of metal materials.

In use, the dart A is manually grasped by the fingers of the user and propelled toward the target T or like member. On impact, the point 16 will initially pierce the surface of the target T and the shaft 54 will essentially be stopped by the relatively hard material forming the target T. As this occurs, the forward momentum of the body 10 will cause the rear pointed end 62 of the head 58 to engage the flat wall 48 of the recess 42. As this occurs, an initial separation will result between the fore body section 12 and the aft body section 14. Moreover, due to the inertial movement of the fore body section 12, this body section 12 will separate from the rear body section 14 and slide along the guide sleeve 64 in a forwardly direction, until it reaches its forwardmost position, as illustrated in FIG. 3 of the drawings.

FIG. 2 of the drawings illustrates the relationship of the various components when they are in the coupled position, and FIG. 3 illustrates the position of the components after the initial separation. It can be observed that as the fore body section 12 is urged away from the aft body section 14, the boss 24 is removed from the recess 42. As this occurs, the tapered head 58 is not sufficient to retain the aft body section 14 on the shaft 54. Consequently, the aft body section 14 will fall off of the main shaft 54, as illustrated in FIG. 4 of the drawings.

It should be observed that upon impact, the head 58 will cause an initial separation and the inertial movement of the fore body 12 will cause the ultimate separation, thereby enabling a complete separation of the aft body section 14 from the fore body section 12. In this same respect, it should be observed that the head 58 could be formed in other shapes which would enable the same results, such as a cylindrical shape, although the shape of the tapered head 58 is preferred.

Thus, there has been illustrated and described a unique and novel segmented dart which has been constructed in accordance with and embodies the present invention and which therefore fulfills all of the objects and advantages sought therefor. It should be understood, however, that many changes, modifications, variations and other uses and applications could become apparent to those skilled in the art after considering this disclosure and the accompanying drawings hereof. Therefore, any and all such changes, modifications, variations and other uses and applications are deemed to be covered by the present invention which is limited only by the following claims.

Having thus described my invention, what I desire to claim and secure by letters patent is:

1. A dart comprising:

a. an elongated body member having a first end and a second end and having a recess formed in said first end, b. a pin section having 1. a central shaft extending normal with respect to said body member,
2. a pointed end member on an end of said shaft mast distal to said recess and capable of being propelled into a target or like member,
3. connecting means including a head which is substantially diametrally enlarged with respect to said shaft and on the opposite end thereof with respect to said pointed end member, said head being sized and shaped so that it is capable of extending into said recess for retentively, but removably, holding said pin section to said body member, c. and an automatic disconnect means including a sleeve member extendible over said central shaft to disconnect said body member from said pin section when said pin section impacts on said target or like member.

2. The dart of claim 1 further characterized in that tail fins are located on the second end of said body section.

3. The dart of claim 1 further characterized in that tail fins are removably located on the second end of said body section.

4. The dart of claim 1 further characterized in that said body member comprises a fore body section and an aft body section, said recess being formed in said aft body section, said pin section comprises said pointed end member and said shaft extending outwardly therefrom, and which shaft extends through said fore body section and which fore body section forms part of said disconnect means.

5. A hand propelled projectile comprising:

a. an elongate body member comprised of:

1. a fore body section having a forward end and a rearward end,
2. an extended portion in the rearward end of said fore body section,
3. means forming a central bore in said fore body section,
4. an aft body section having a forward end and a rearward end, and having a recess formed in the forward end of said aft body section, and capable of receiving the extended portion of said fore body section in retentively, but removable, engagement therewith, b. a pin section comprised of:
1. a main shaft,
2. a pointed end on one end of said main shaft capable of being propelled into a target or like member,
3. a an enlarged head on the opposite end of said shaft with respect to said pointed end and being disposed in said recess,
4. said main shaft extending through the central bore in said fore body section and said fore body section being shiftable with respect to said shaft when said pointed end engages a relatively hard surface causing disengagement between said extended portion and said recess to permit separation of said aft body section from said fore body section.

6. The projectile of claim 5 further characterized in that said projectile is a dart.

7. The projectile of claim 5 further characterized in that a hub is formed on said main shaft and said fore body section is in sliding contact with said hub.

8. The projectile of claim 5 further characterized in that said head extends further into said recess upon said impact to cause an initial separation between said fore and aft body sections and that the inertial movement of said projectile causes movement of said fore body section away from said aft body section.

9. The projectile of claim 5 further characterized in that tail fins are removably connected to the second end of said aft body section.

10. A dart comprising:

a. an elongated body member comprised of:
1. a fore body section having an outer surface and a first transverse end and a second transverse end,
2. an aft body section having an outer surface and a first transverse end and a second transverse end and having a recess in said first transverse end,
3. the second end of the fore body section and the first end of the aft body section being abutable and the outer surfaces of both said sections being of substantially the same size and shape so as to be substantially contiguous in the region of abutment, b. a pin section having:
1. a central shaft extending normal to said body member and extending through said fore body section,
2. a pointed end member on an end of said shaft distal to said recess and capable of being propelled into a target or like member,
3. connecting means including a head which is substantially diametrally enlarged with respect to said shaft and on the opposite end thereof with respect to said pointed end member, said head being sized and shaped so that it is capable of extending into said recess for retentively, but removably, holding said pin section to said body member, c. and an automatic disconnect means, including at least in part said fore body section, to disconnect said body member from said pin section when said pin section impacts on said target or like member.

11. The dart of claim 15 further characterized in that tail fins are located on the second end of said aft body section.

12. A hand propelled projectile comprising:

a. an elongate body member comprised of:
1. a fore body section having a forward end and a rearward end,
2. a first coupling element at the rearward end of said fore body section,
3. means forming a central bore in said fore body section,
4. an aft body section having a forward end and a rearward end, and having a second coupling element at the forward end of said aft body section, and capable of being in coupling engagement with said first coupling element so that said fore body section is in retentive, but removable, engagement with said aft body section, b. a pin section comprised of:
1. a main shaft,
2. a pointed end on one end of said main shaft capable of being propelled into a garget or like member,
3. an enlarged head on the opposite end of said shaft with respect to said pointed end and being disposed in retentive, but removable, coupling arrangement with a portion of said second coupling element when said first coupling element is in coupling engagement with said second coupling element,
4. said main shaft extending through the central bore in said fore body section and said fore body section being shiftable with respect to said shaft when said pointed end engages a relatively hard surface causing disengagement between said first coupling element and second coupling element to permit separation of said aft body section from said fore body section.

13. The projectile of claim 12 further characterized in that a hub is formed on said main shaft and said fore body section is in sliding contact with said hub.

14. A method of using a projectile of the type projected by manual action into a target or like member, and which projectile comprises a fore body section and an aft body section connectable to said fore body section with a shaft extending through said fore body section and having a pointed end thereon, said method comprising:

a. propelling said projectile toward said target or like member,
b. causing an impact between said target or like member and a pointed end on said shaft,
c. causing an enlarged head on said shaft opposite to said pointed end to shift and impact within a recess in said aft body section thereby causing an initial impact separation between said fore body section and said aft body section of said projectile upon impact, and
d. causing an inertial complete separation between said fore body section and said aft body section after said initial impact due in part to inertial movement of the then separated fore body section.

15. The method of claim 14 further characterized in that a tail fin section is on said aft body section and said aft body section and tail fin section separate from said fore body section upon said inertial complete separation.

16. The method of claim 14 further characterized in that said projectile is a hand-held dart.

* * * * *